US010227203B2

(12) United States Patent
Ye

(10) Patent No.: US 10,227,203 B2
(45) Date of Patent: Mar. 12, 2019

(54) ROTARY-TYPE FILM FOLDING MACHINE

(71) Applicant: TAIZHOU LIFENG MANUFACTURING CORPORATION, Taizhou, Zhejiang (CN)

(72) Inventor: Yu Ye, Zhejiang (CN)

(73) Assignee: TAIZHOU LIFENG MANUFACTURING CORPORATION, Sanjia, Jiaojiang, Taizhou, Zhejiang (CN)

( * ) Notice: Subject to any disclaimer, the term of this patent is extended or adjusted under 35 U.S.C. 154(b) by 395 days.

(21) Appl. No.: 15/219,892

(22) Filed: Jul. 26, 2016

(65) Prior Publication Data

US 2017/0136723 A1 May 18, 2017

(30) Foreign Application Priority Data

Nov. 17, 2015 (CN) ..... 2015 1 0789665

(51) Int. Cl.
*B65H 54/00* (2006.01)

(52) U.S. Cl.
CPC ..... *B65H 54/00* (2013.01)

(58) Field of Classification Search
CPC ..... B65H 54/00; B31B 19/26; B31B 23/00; B31B 2219/2654; B31B 2237/10; B31B 2237/60; B31B 50/26; B31B 70/26
USPC .... 493/30, 26, 343, 344, 349, 356, 217, 457
See application file for complete search history.

(56) References Cited

U.S. PATENT DOCUMENTS 3,868,895 A * 3/1975 Hart ..... F16L 58/1054 493/457
4,075,938 A * 2/1978 Martinek ..... A22C 13/0009 452/46
4,106,398 A * 8/1978 Buisson ..... B29C 53/08 493/217

* cited by examiner

*Primary Examiner* — Robert Long
*Assistant Examiner* — Xavier A Madison
(74) *Attorney, Agent, or Firm* — Global IP Services; Tianhua Gu

(57) ABSTRACT

A rotary-type film folding machine comprises a feeding mechanism providing a tubular material for a folding mechanism in an axial direction, with a first driving mechanism driving the feeding mechanism to operate; a folding mechanism folding the tubular material delivered by the feeding mechanism, with a second driving mechanism driving the rotation of an outer sheath of the folding mechanism; a pressing mechanism pressing the tubular material folded by the folding mechanism, with a third driving mechanism driving the rotation of a first inner rotor for rotating the pressing mechanism and the folding mechanism; said pressing mechanism being driven by a fourth driving mechanism to move up and down; and the operations of the first, second, third and fourth driving mechanisms are controlled by a controller.

20 Claims, 9 Drawing Sheets

ROTARY-TYPE FILM FOLDING MACHINE

TECHNICAL FIELD

The present invention belongs to the technical field of tubular material folding apparatuses, in particular refers to a rotary-type film folding machine.

BACKGROUND ART

Diaper bags are formed by folding tubular materials made of plastic thin films. When not in use, the folded tubular material is arranged between a mounting disc and an upper cover and is pressed. When in use, a connection device between the upper cover and the mounting disc is opened, and a relatively large storage space is formed in the tubular material. At present, an apparatus for manufacturing axially folded tubular materials performs pressing and folding on an annular cavity disposed in a mould by means of a pressing and folding mechanism, so as to manufacture the axially folded tubular materials. Products manufactured by such an apparatus tend to be uneven and irregular in axial folding, and is inconvenient in use.

SUMMARY OF THE INVENTION

The purpose of the present invention is to provide a rotary-type film folding machine with a high automation degree and a high production efficiency.

The present invention is achieved by:

a rotary-type film folding machine, comprising:

a feeding mechanism providing a tubular material for a folding mechanism in an axial direction, comprising a frame body, a material shaft and one or more feeding rollers being provided on the frame body, a tubular body being provided on a lower part of the frame body, and a first driving mechanism driving the tubular body to rotate so as to drive the rotation of the frame body;

a folding mechanism folding the tubular material delivered by the feeding mechanism, comprising a first inner rotor and an outer sheath, spiral pieces being respectively being provided on an outer wall of the first inner rotor and on an inner wall of the outer sheath, a folding cavity for the tubular material being formed between the first inner rotor and the outer sheath, and said outer sheath being driven by a second driving mechanism to rotate;

a pressing mechanism pressing the tubular material folded by the folding mechanism, comprising a second inner rotor, an elastic seat and a fixing sleeve being successively sheathed outside the second inner rotor, a mounting seat being provided outside the fixing sleeve, being capable of axially moving along the fixing sleeve and being elastically connected to the elastic seat at an upper end of the fixing sleeve, the second inner rotor being driven by a third driving mechanism to rotate, and the second inner rotor being connected to the first inner rotor of the folding mechanism so as to drive the first inner rotor to rotate together;

said pressing mechanism being driven by a fourth driving mechanism to move up and down so as to achieve the connection and disconnection of the first inner rotor of the folding mechanism and the second inner rotor of the pressing mechanism; and the operations of said first, second, third and fourth driving mechanisms being controlled by a controller.

In the above-mentioned technical solution, said first driving mechanism comprises a first electric motor, a first input gear is provided on an output shaft of the first electric motor, a first output gear in meshed transmission with the first input gear is provided outside a tubular body of the feeding mechanism, and the first electric motor rotates to drive the rotation of the feeding mechanism via the meshed transmission of the first input gear and the first output gear.

In the above-mentioned technical solution, a circuit between said controller and the first driving mechanism is provided with a fine-tuning knob for fine-tuning the rotation speed of the first electric motor and a first switch for powering on and off the first driving mechanism.

In the above-mentioned technical solution, said second driving mechanism comprises a second electric motor, a second input gear is provided on an output shaft of the second electric motor, a second output gear is arranged on the outer surface of the outer sheath of the folding mechanism, and the second input gear and the second output gear are in meshed transmission so as to drive the rotation of the outer sheath.

In the above-mentioned technical solution, said third driving mechanism and the second driving mechanism both use a second electric motor as power, a third input gear is further provided in the corresponding position on the output shaft of the second electric motor, the second inner rotor of the pressing mechanism is connected to a third output gear in meshed transmission with the third input gear, and the third output gear drives the second inner rotor to rotate and also drives the first inner rotor to rotate together after the first inner rotor is connected to the second inner rotor.

In the above-mentioned technical solution, further comprised is a position sensor for sensing the connection between the folding mechanism and the pressing mechanism, and when the position sensor senses the connection between the folding mechanism and the pressing mechanism, a signal is sent to the controller, and the controller controls the first electric motor and the second electric motor to work at the same time and in turn drive the first driving mechanism, the second driving mechanism and the third driving mechanism to operate at the same time.

In the above-mentioned technical solution, said feeding roller comprises a roller pair which consists of a driving roller and a driven roller, the driving roller is driven by a fifth driving mechanism to rotate, and the operation of the fifth driving mechanism is controlled by the controller.

In the above-mentioned technical solution, said fifth driving mechanism is a belt transmission mechanism, comprising a third electric motor, a belt wheel is provided on an output shaft of the electric motor, an annular groove is provided on the driving roller, and a belt connects the belt wheel and the groove of the driving roller.

In the above-mentioned technical solution, several rubber rings for increasing frictions are arranged at intervals on the outer surface of said driven roller.

In the above-mentioned technical solution, on one side of said driving roller, a meter counter is provided for counting the feeding length of the tubular material according to the number of rotations of the driving roller, said meter counter is electrically connected to the controller, and the controller controls downtime of the machine.

In the above-mentioned technical solution, said feeding roller further comprises support rollers arranged on the frame body below the roller pair, said support rollers are arranged at two ends of the connecting frame, and the middle part of the connecting frame is swingably connected to the frame body via a connecting shaft.

In the above-mentioned technical solution, said feeding mechanism is provided with a sensor, the sensor pulls the tubular material after sensing the connection between the pressing mechanism and the folding mechanism and sends a signal to the controller, and the controller controls the operation of the third electric motor to in turn control the operation of the fifth driving mechanism.

In the above-mentioned technical solution, further comprised is a cutting mechanism.

In the above-mentioned technical solution, said cutting mechanism comprises a cutting support, an upper part of the cutting support is connected to a gas cylinder, a lower part of the cutting support is provided with a heating cutting wire, the gas cylinder drives the cutting support to swing, the heating cutting wire cuts the tubular material or resets after the cutting is completed, and the operation of said gas cylinder and the heating of the heating cutting wire are both controlled by the controller.

In the above-mentioned technical solution, further comprised is a fan for cooling the pressing mechanism and the folding mechanism.

In the above-mentioned technical solution, the support of said pressing mechanism is provided with a counting device.

In the above-mentioned technical solution, said counting device comprises a counter, a display screen for displaying a number, and a magnet cooperating with the counter, and when the pressing mechanism is lifted or lowered, the magnet and the counter sense and count the number of processes.

In the above-mentioned technical solution, several axially arranged strip-shaped guiding grooves are circumferentially distributed on the fixing sleeve of said pressing mechanism, and lower ends of the strip-shaped guiding grooves do not penetrate the wall of the fixing sleeve while upper ends of the strip-shaped guiding grooves penetrate the wall of the fixing sleeve;

said elastic seat comprises several stand poles, a spring is sheathed outside the stand pole, the stand pole at the upper end of the spring is further provided with a movable block which moves up and down along the stand pole, the movable block is limited on the inner top face of the fixing sleeve, and clamping grooves are arranged on the movable block in one-to-one correspondence with the strip-shaped guiding grooves;

said mounting seat comprises an upper seat, a bottom seat, and a hand lever located between the upper seat and the bottom seat, the hand lever is provided with circumferentially distributed arc-shaped inclined guide grooves and arc-shaped guide grooves, clamping pins are radially arranged on the upper seat, the positions of the clamping pins are in one-to-one correspondence with the strip-shaped guiding grooves on the fixing sleeve, the clamping pin is provided with a guiding rod in an axial direction, the guiding rod is connected to the arc-shaped inclined guide groove on the hand lever, a guiding post is provided in the arc-shaped groove, and the upper seat is connected to the bottom seat via a screw passing through the guiding post;

when the mounting seat axially moves above the fixing sleeve, the hand lever is rotated such that the clamping pin moves along the arc-shaped inclined guide groove to extend out of the upper seat and passes through the upper end of the strip-shaped guiding groove and extend into the clamping groove of the movable block of the elastic seat so as to connect to the elastic seat; or is retracted into the upper seat, such that the mounting seat moves downward along the fixing sleeve to reset.

In the above-mentioned technical solution, a circuit of said controller and the fourth driving mechanism is provided with a second switch or a third switch for controlling the on-off of the fourth driving mechanism.

In the above-mentioned technical solution, a circuit between said controller and the power source is provided with an emergency switch.

Compared with the prior art, the present invention has the prominent advantages as follows:

1. according to the present invention, folding a tubular material under control of a controller has a high automation degree, a high folding efficiency, and a low labor cost, and one person can operate multiple machines at the same time such that the working efficiency is high;

2. the present invention has a good folding effect, the folded tubular material is even and ordered, and the manufactured product has a stable quality; and 3. the present invention has a low use cost and maintenance cost, and is suitable for mass production.

PARTICULAR EMBODIMENTS

Figure 1:
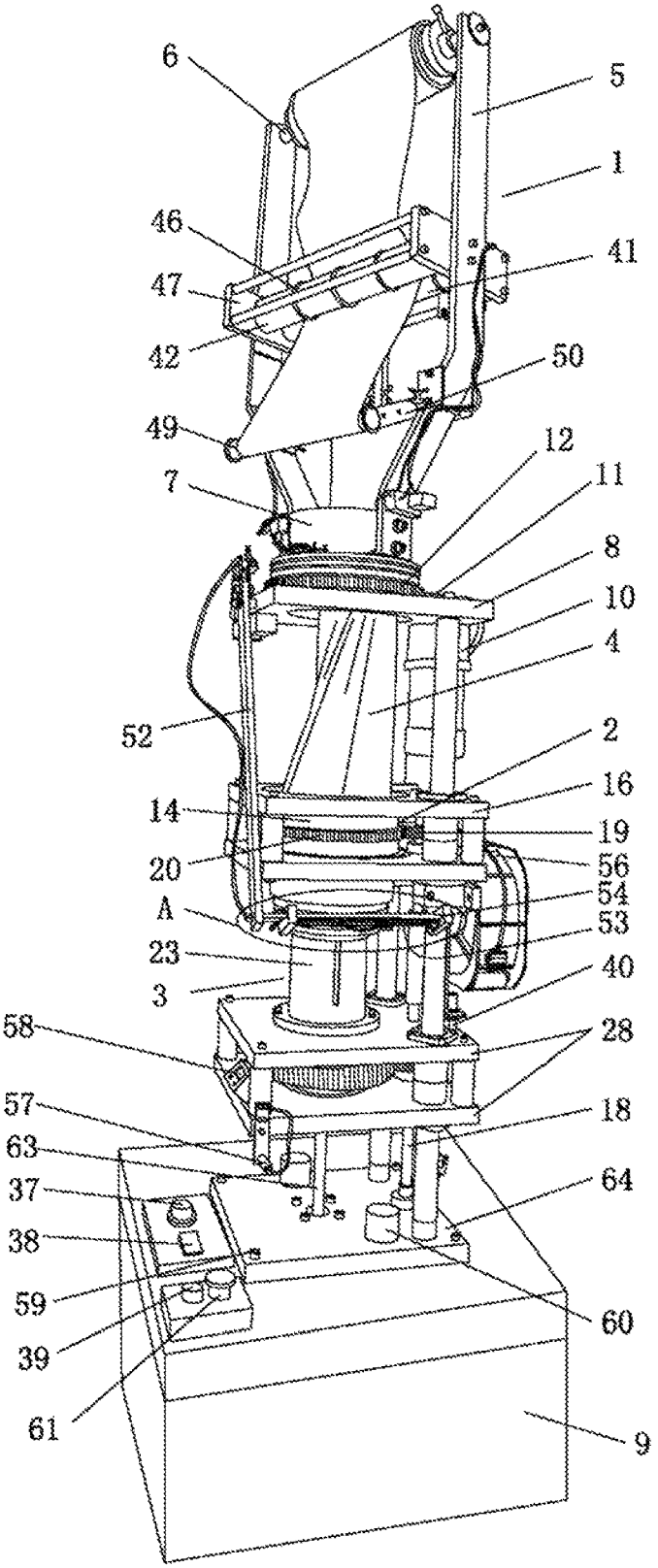
FIG. 1 is a perspective schematic view of the present invention.
Figure 2:
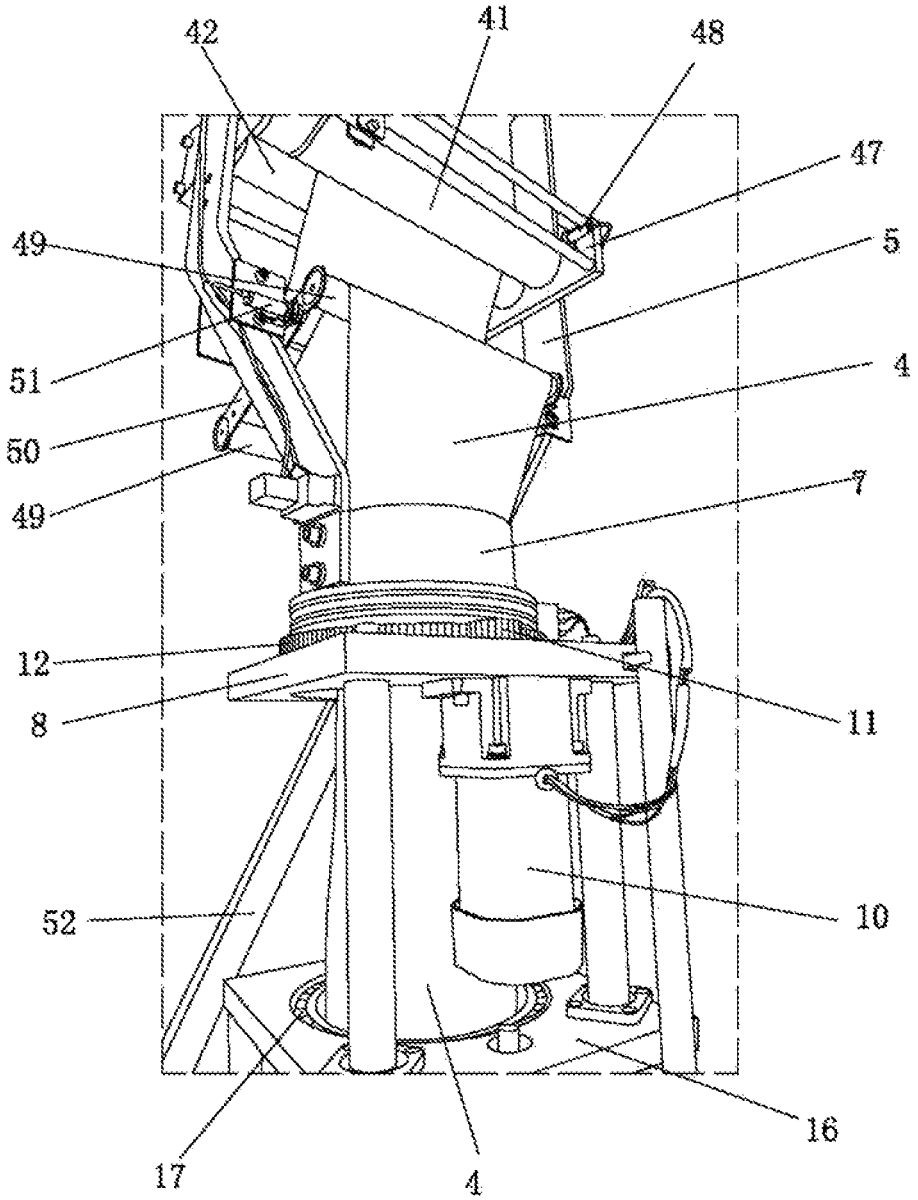
FIG. 2 is a schematic view of a feeding mechanism of the present invention.
Figure 3:
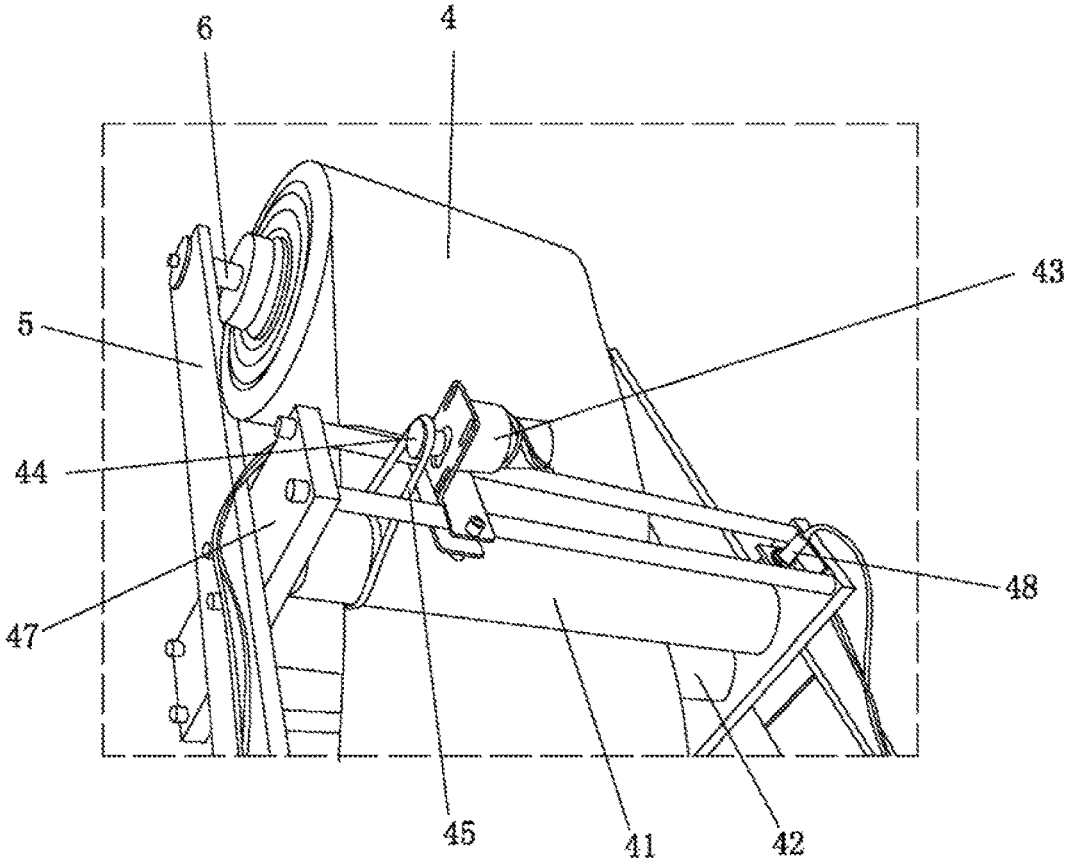
FIG. 3 is a partial schematic view of the feeding mechanism of the present invention.
Figure 4:
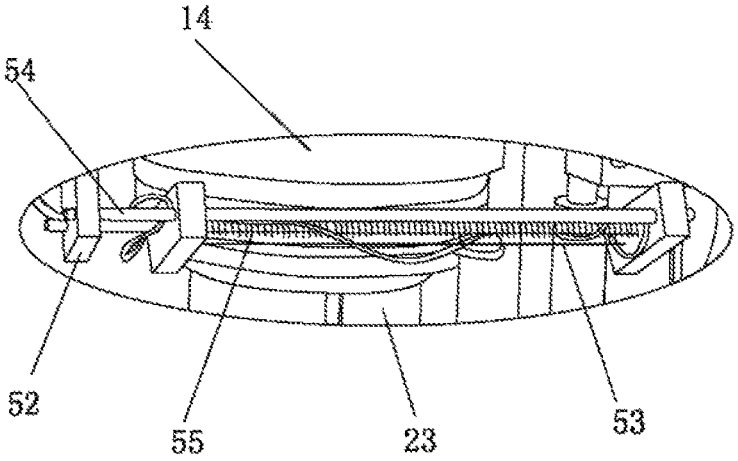
FIG. 4 is an enlarged schematic view of section A in FIG. 1.
Figure 5:
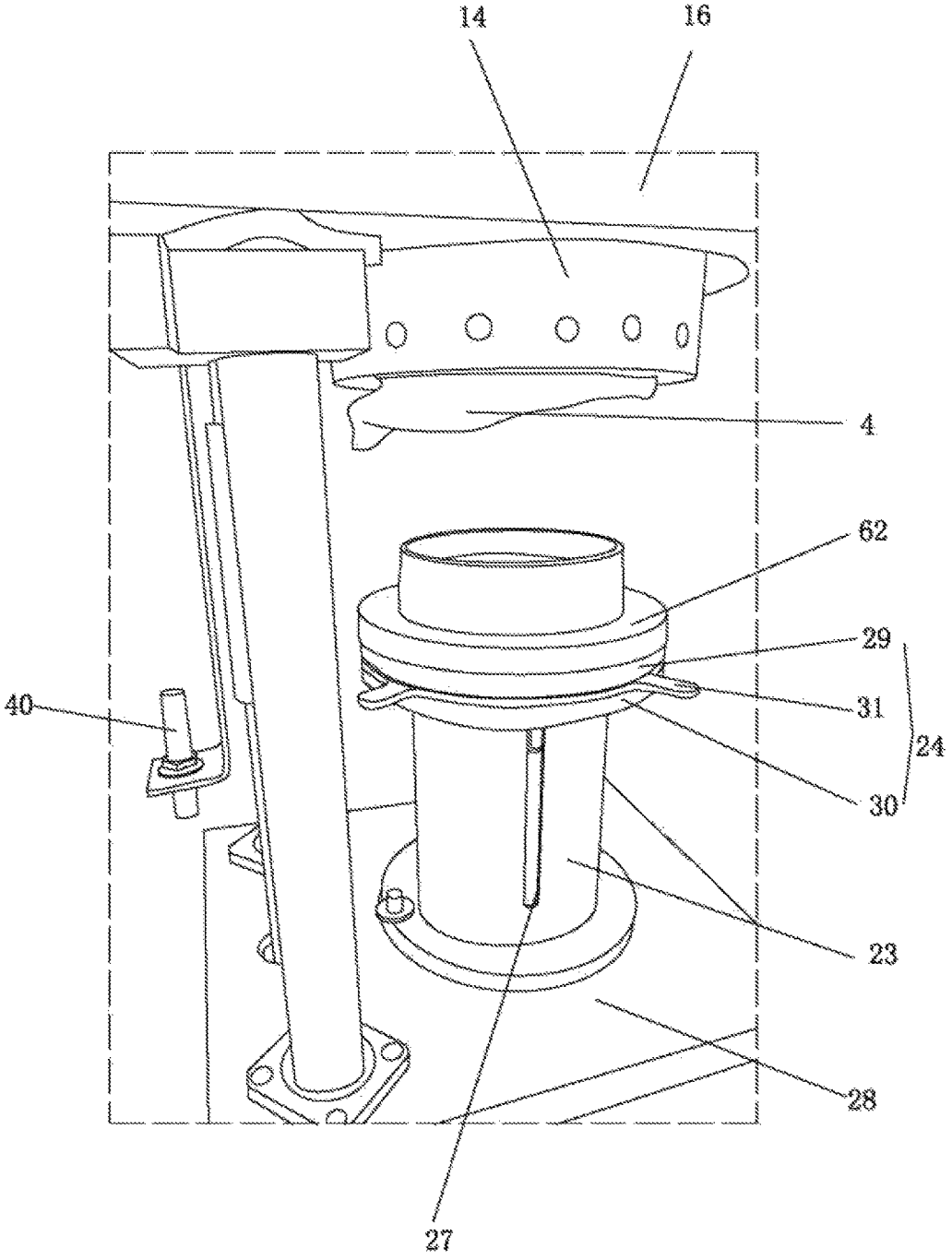
FIG. 5 is a schematic view of a pressing mechanism of the present invention.
Figure 6:
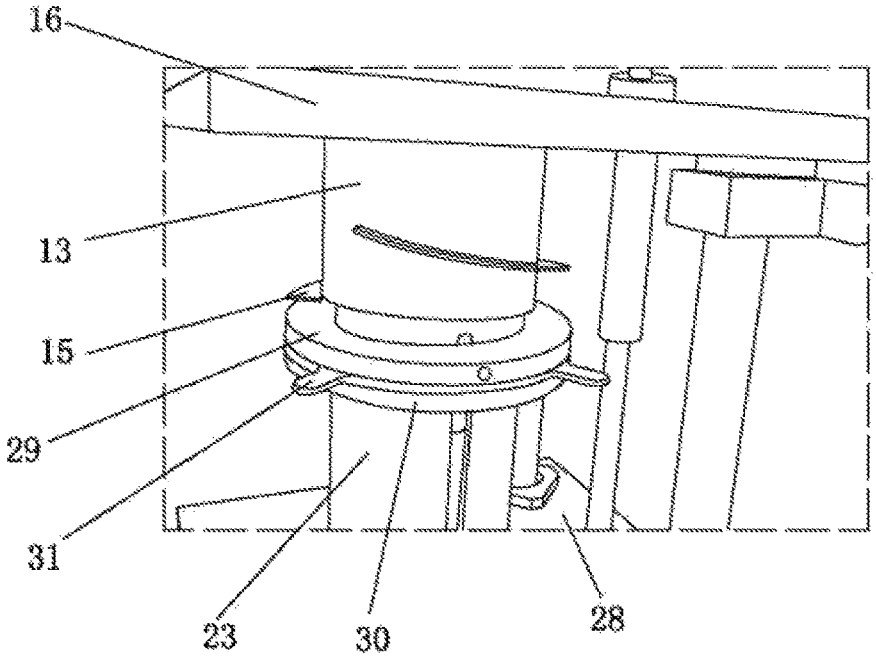
FIG. 6 is a schematic view of the connection between a first inner rotor and the pressing mechanism of the present invention.
Figure 7:
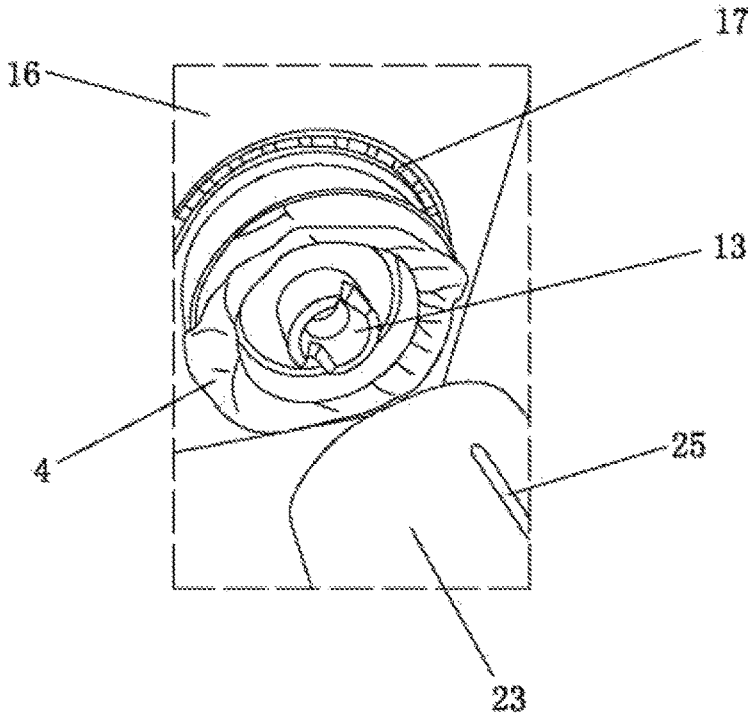
FIG. 7 is a schematic view of the pressing mechanism with a mounting seat of the present invention located below same.
Figure 8:
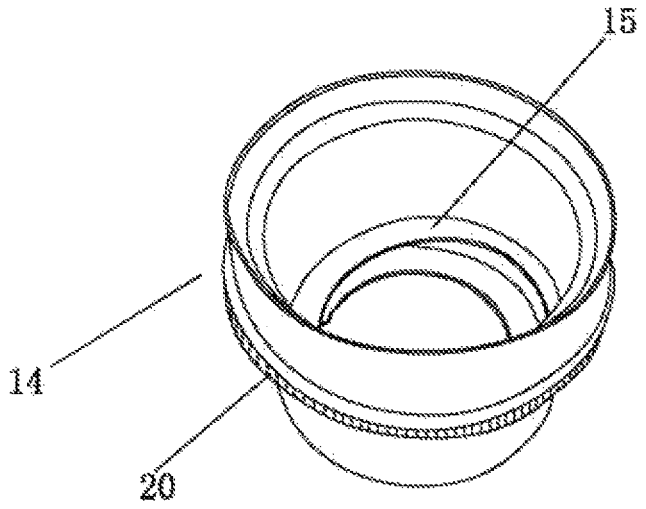
FIG. 8 is a schematic view of an outer sheath of a folding mechanism of the present invention.
Figure 9:
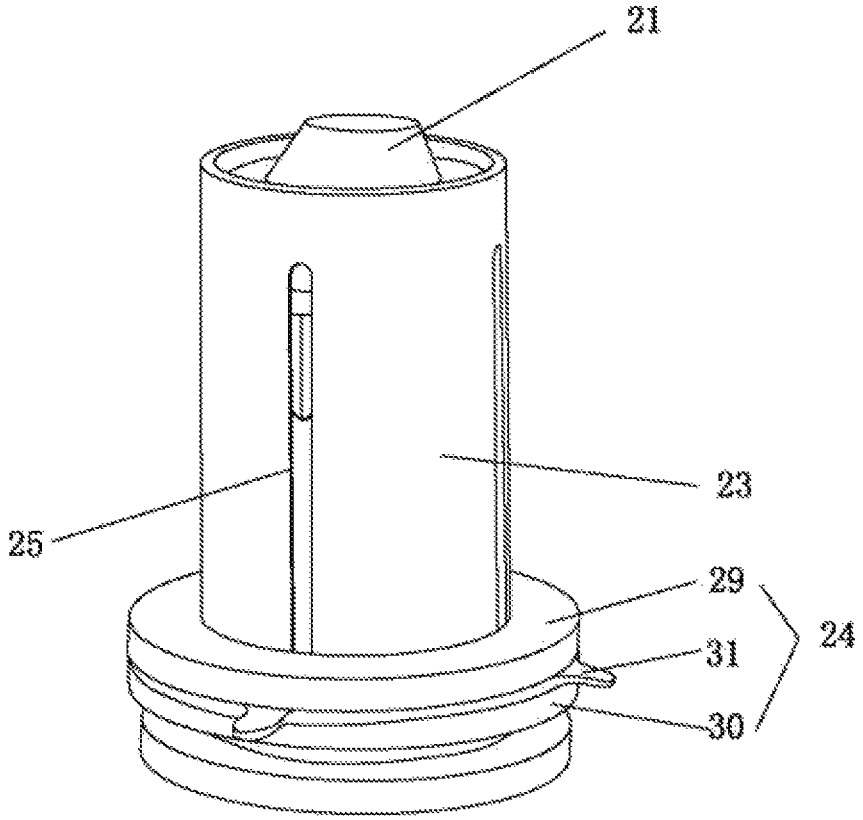
FIG. 9 is a schematic view of the pressing mechanism of the present invention.
Figure 10:
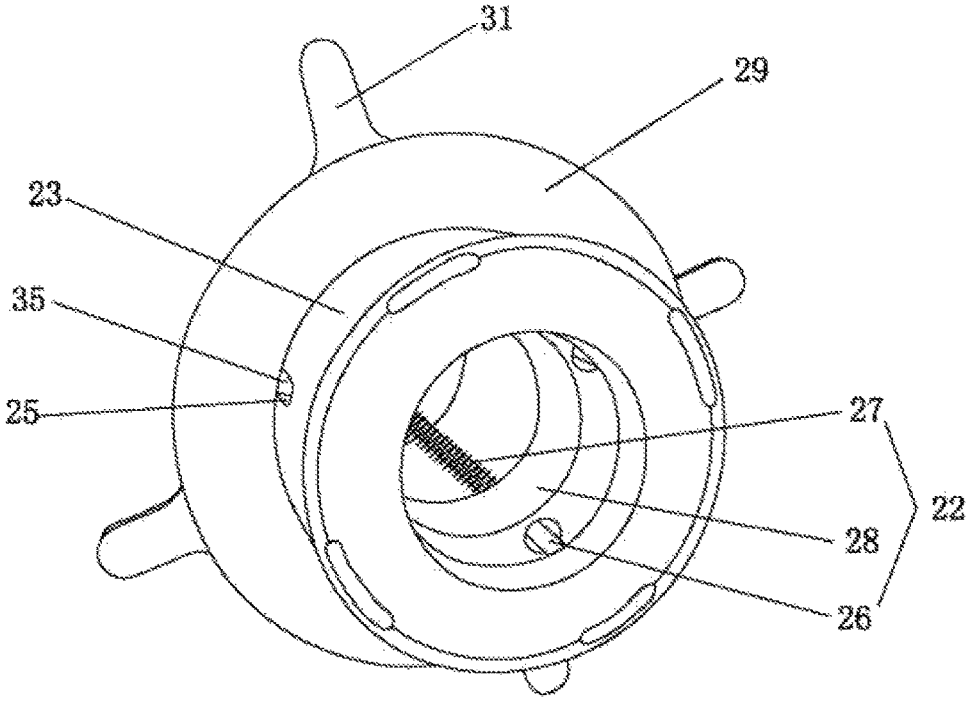
FIG. 10 is a schematic view of the pressing mechanism without a second inner rotor of the present invention.
Figure 11:
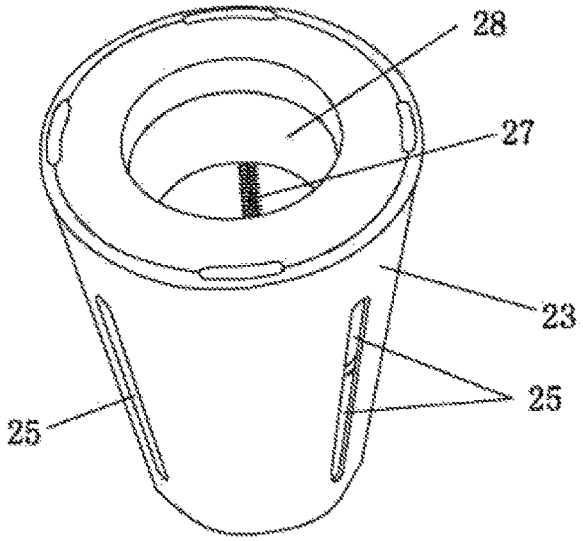
FIG. 11 is a schematic view of the pressing mechanism with an elastic seat arranged in a fixing sleeve of the present invention.
Figure 12:
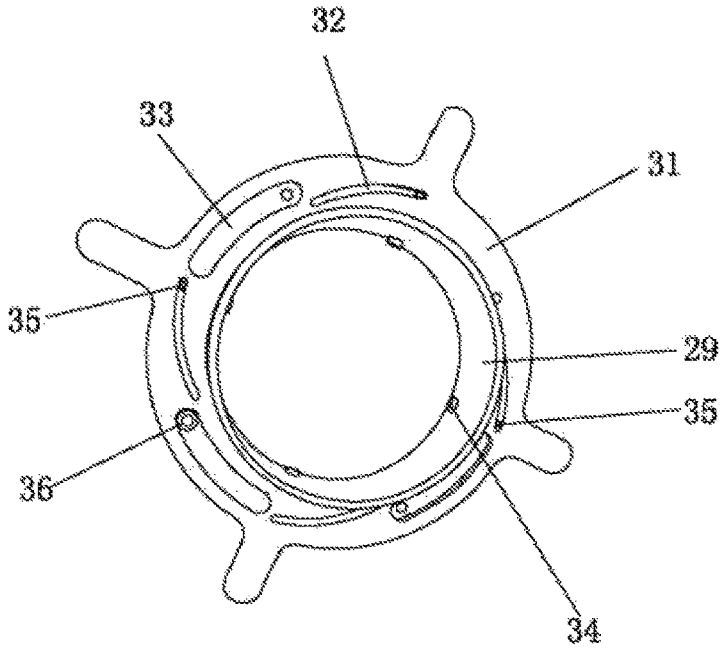
FIG. 12 is a schematic view of the present invention where a hand lever is connected to an upper seat and a clamping pin does not extend out.
Figure 13:
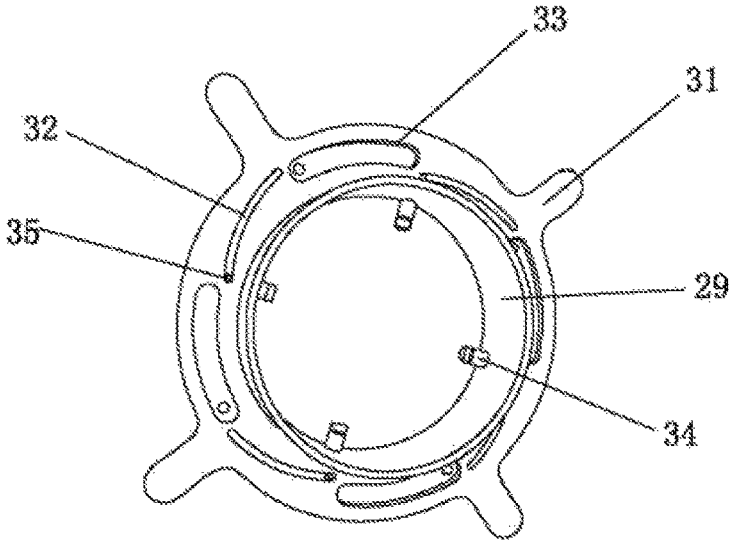
FIG. 13 is a schematic view of the present invention where the hand lever is connected to the upper seat and the clamping pin extends out.
Figure 14:
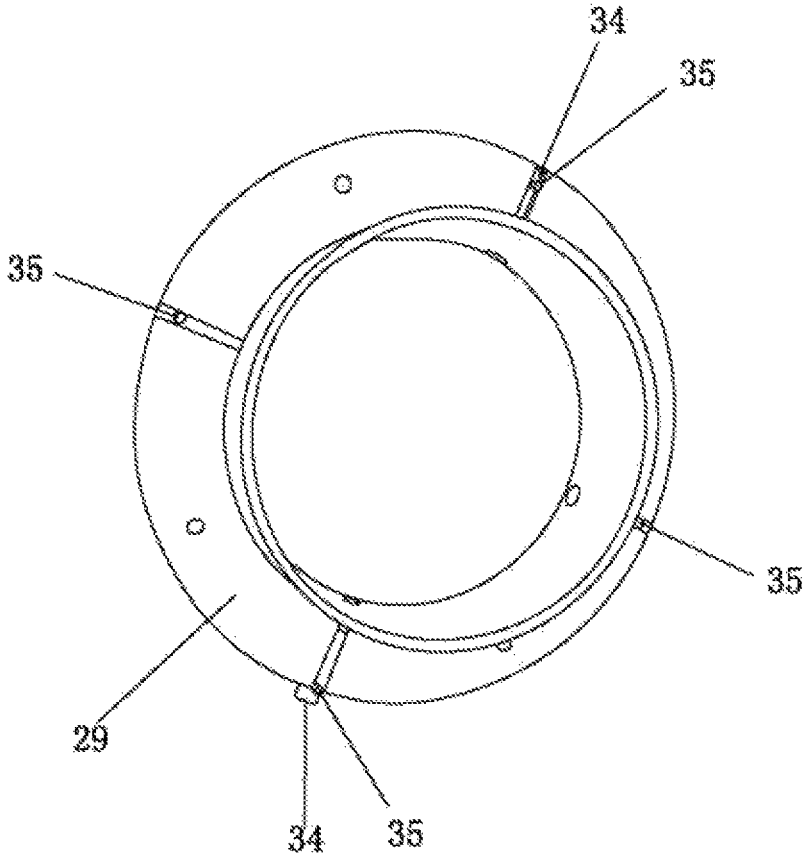
FIG. 14 is a schematic view of the clamping pin arranged on the upper seat of the present invention.
Figure 15:
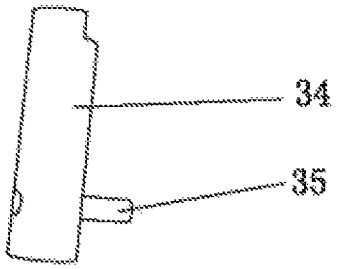
FIG. 15 is a schematic view of the clamping pin of the present invention.

The present invention is further described in combination with particular embodiments as below, see FIGS. 1-15:

a rotary-type film folding machine, comprising a feeding mechanism 1, a folding mechanism 2 and a pressing mechanism 3, which are successively arranged at intervals from top to bottom via supports, wherein the feeding mechanism 1 provides a tubular material 4 for the folding mechanism 2 in an axial direction and comprises a frame body 5, a material shaft 6 and one or more feeding rollers are provided on the frame body 5, and the material shaft 6 and the frame body 5 are connected in a detachable manner, which facilitates mounting of the tubular material 4. The lower part of the frame body 5 is provided with a tubular body 7, a first driving mechanism drives the tubular body 7 to rotate so as to drive the rotation of the frame body 5, the tubular body 7 is provided on a feeding mechanism mounting plate 8, and the feeding mechanism mounting plate 8 is provided with a through hole for the tubular material 4 to pass through. The rotation of the feeding mechanism 1 can prevent the tubular material 4 from winding which may cause the tubular material 4 to not be able to be delivered axially and folded. The operation of the first driving mechanism is controlled by a controller 9.

Said first driving mechanism comprises a first electric motor 10, and the first electric motor 10 is provided on the feeding mechanism mounting plate 8. A first input gear 11 is provided on an output shaft of the first electric motor 10, a first output gear 12 in meshed transmission with the first input gear 11 is provided outside the tubular body 7 of the feeding mechanism 1, and the first electric motor 10 rotates to drive the rotation of the feeding mechanism 1 via the meshed transmission of the first input gear 11 and the first output gear 12.

The folding mechanism 2 folds the tubular material 4 delivered by the feeding mechanism 1, and comprises a first inner rotor 13 and an outer sheath 14, spiral pieces 15 are respectively provided on an outer wall of the first inner rotor 13 and on an inner wall of the outer sheath 14, a folding cavity of the tubular material 4 is formed between the first inner rotor 13 and the outer sheath 14, and two spiral pieces 15 interact to realize the folding of the tubular material 4. Said outer sheath 14 is driven by a second driving mechanism to rotate. The folding mechanism 2 is provided on a folding mechanism mounting plate 16. A bearing 17 is provided between the folding mechanism mounting plate 16 and the outer sheath 14 such that the outer sheath 14 rotates more flexibly.

Said second driving mechanism comprises a second electric motor, a second input gear 19 is provided at an output shaft 18 of the second electric motor, a second output gear 20 is provided on an outer surface of the outer sheath 14 of the folding mechanism 2, and the second input gear 19 and the second output gear 20 are in meshed transmission so as to drive the rotation of the outer sheath 14.

The pressing mechanism 3 presses the tubular material 4 folded by the folding mechanism 2, and comprises a second inner rotor 21, an elastic seat 22 and a fixing sleeve 23 are successively sheathed outside the second inner rotor 21, a mounting seat 24 is arranged outside the fixing sleeve 23, the mounting seat 24 can axially move along the fixing sleeve 23, and the mounting seat 24 is elastically connected to the elastic seat 22 at the upper end of the fixing sleeve 23, the second inner rotor 21 is driven by a third driving mechanism to rotate, and the second inner rotor 21 is connected to the first inner rotor 13 of the folding mechanism 2 so as to drive the first inner rotor 13 to rotate together. The pressing mechanism 3 is provided on a pressing mechanism mounting plate 28, and a bottom plate 46 is provided below the pressing mechanism mounting plate 28.

Several axially arranged strip-shaped guiding grooves 25 are circumferentially distributed on the fixing sleeve 23 of said pressing mechanism 3, and lower ends of the strip-shaped guiding grooves 25 do not penetrate the wall of the fixing sleeve while upper ends of the strip-shaped guiding grooves 25 penetrate the wall of the fixing sleeve;

said elastic seat 22 comprises several stand poles 26, a spring 27 is sheathed outside the stand pole 26, the stand pole 26 at the upper end of the spring 27 is further provided with a movable block 28 which moves up and down along the stand pole 26, the movable block 28 is limited on the inner top face of the fixing sleeve 23, and clamping grooves are arranged on the movable block 28 in one-to-one correspondence with the strip-shaped guiding grooves 25;

said mounting seat 24 comprises an upper seat 29, a bottom seat 30, and a hand lever 31 located between the upper seat 29 and the bottom seat 30, the hand lever 31 is provided with circumferentially distributed arc-shaped inclined guide grooves 32 and arc-shaped guide grooves 33, the arc-shaped inclined guide grooves 32 and the arc-shaped guide grooves 33 are distributed at intervals, the upper seat 29 is provided with clamping pins 34 in a radial direction, the positions of the clamping pins 34 are in one-to-one correspondence with the strip-shaped guiding grooves 25 on the fixing sleeve 23, the clamping pins 34 are provided with guiding rods 35 in an axial direction, the guiding rods 35 are connected to the arc-shaped inclined guide grooves 32 on the hand lever 31, guiding posts 36 are provided in the arc-shaped grooves 33, and the upper seat 29 is connected to the bottom seat 30 via a screw passing through the guiding posts 36; and the height of the guiding post 36 is greater than the thickness of the hand lever 31 such that the hand lever 31 flexibly rotates between the upper seat 29 and the bottom seat 30, and at the same time, its friction with the upper seat 29 and the bottom seat 30 is also reduced.

When the mounting seat 24 axially moves above the fixing sleeve 23, the hand lever 31 is rotated such that the clamping pin 34 moves along the arc-shaped inclined guide groove 32 to extend out of the upper seat 29 and into the clamping groove of the movable block 28 of the elastic seat 22 so as to connect to the elastic seat 22; or is retracted into the upper seat 29, such that the mounting seat 24 moves downward along the fixing sleeve 23 to reset.

When the clamping pin 34 is connected to the elastic seat 22, the tubular material 4 folded by the folding mechanism 2 applies a downward force to the mounting seat 24, such that the movable block 28 compresses the spring 27, and the mounting seat 24 axially moves downward step by step along the upper part of the strip-shaped guiding groove 25.

In order to prevent the asynchronization in the rotation speeds of the first electric motor 10 of the first driving mechanism, the second electric motor of the second driving mechanism and the third driving mechanism, a circuit between the controller 9 and the first driving mechanism is provided with a fine-tuning knob 37 for fine-tuning the rotation speed of the first electric motor 10 and a first switch 38 for powering on and off the first driving mechanism. Since the asynchronous rotation speeds of the first electric motor 10 and the second electric motor may cause the winding of the tubular material 4, the controller 9 is controlled by the fine-tuning knob so as to maintain synchronous rotation of the first electric motor 10 and the second electric motor. The first switch 38 is arranged such that the first electric motor 10 can be temporarily powered off so as to adjust the rotation speed or to unwind the wound tubular material 4. The rotation speed of the second electric motor is adjusted by a variable-frequency drive in the controller 9.

Said pressing mechanism 3 is driven by a fourth driving mechanism to move up and down so as to achieve the connection and disconnection of the first inner rotor 13 of the folding mechanism 2 and the second inner rotor 21 of the pressing mechanism 3; and the fourth driving mechanism uses a gas cylinder or an oil cylinder. A circuit of the controller 9 and the fourth driving mechanism is provided with a second switch 39 or a third switch for controlling the on-off of the fourth driving mechanism. When the fourth driving mechanism is a gas cylinder, the second switch 39 and the third switch control the start and stop of the gas cylinder. The present embodiment uses a pedal switch as the third switch.

A position sensor 40 for sensing the connection between the folding mechanism 2 and the pressing mechanism 3 is provided on the pressing mechanism mounting plate 28; after the pressing mechanism 3 and the pressing mechanism mounting plate 28 are lifted by the gas cylinder and connected to the folding mechanism 2, the pressing mechanism mounting plate 28 is in sensing contact connection with the position sensor 40, the position sensor 40 is touched and turned on to send a signal to the controller 9, and the controller 9 controls the first electric motor 10 and the second electric motor to work at the same time and in turn drive the operations of the first driving mechanism, the second driving mechanism and the third driving mechanism.

The feeding roller of the present embodiment comprises a roller pair which consists of a driving roller 41 and a driven roller 42, the driving roller 41 is driven by a fifth driving mechanism to rotate, the fifth driving mechanism is a belt transmission device driven by a third electric motor 43, a belt wheel 44 is provided on an output shaft of the electric motor, the driving roller 41 is provided with an annular groove, and the belt 45 connects the belt wheel 44 and the groove of the driving roller 41. Several rubber rings 46 for increasing frictions are arranged at intervals on the outer surface of the driven roller 42. It facilitates the delivery of the tubular material 4. Instead of belt transmission, gear or chain transmission, etc. can also be used. The driving roller 41 and the driven roller 42 are arranged on a support 47, and the support 47 is fixed on the frame body 5 of the feeding device 1.

On one side of the driving roller 41 mentioned above, a meter counter 48 is provided for counting the feeding length of the tubular material 4 from the number of rotations of the driving roller 41, and said meter counter 48 is electrically connected to the controller 9. When the number counted by the meter counter 48 reaches a preset length, a signal is sent to the controller 9, and the controller 9 controls the machine to stop.

In order to achieve a better delivery, support rollers 49 can also be provided on the frame body 5 below the roller pair, said support rollers 49 are arranged at two ends of a connecting frame 50, and the middle part of the connecting frame 50 is swingably connected onto the frame body 5 via a connecting shaft.

A sensor 51 is provided on the frame body 5 at one side of the support roller 49, the sensor 51 pulls the tubular material 4 so as to operate the support roller 49 after sensing the connection between the pressing mechanism 3 and the folding mechanism 2, a signal is sent to the controller 9, and the controller 9 controls the operations of the third electric motor and in turn controls the operations of the fifth driving mechanism.

The present invention further comprises a cutting mechanism which comprises a cutting support 52, an upper part of the cutting support 52 is connected to the gas cylinder, the cutting support 52 is connected to the feeding mechanism mounting plate 8 via a rotating shaft, and the cutting support 52 can rotate around the rotating shaft. A lower part of the cutting support 52 is provided with a heating cutting wire 53, and the gas cylinder operates to drive the heating cutting wire 53 to cut the tubular material 4 or reset after the cutting is completed. The gas cylinder is mounted on the feeding mechanism mounting plate 8. The operations of the gas cylinder are controlled by a computer program software on the controller 9. The controller 9 also controls the heating of the heating cutting wire 53 after the gas cylinder is lifted. Constant heating, which causes the waste of electric power, is avoided.

The heating cutting wire 53 is provided on a mounting frame, the mounting frame comprises two side plates which are arranged spaced apart from each other, two support beams 54 are provided between the two side plates, a spring 55 is provided on one of the support beams 54, two ends of the spring 55 abut against the two side plates so as to prevent displacement between the two side plates that will cause contraction of the heating cutting wire 53 and affect the cutting effect.

Since the machine tends to get hot in the folding process, the tubular material 4 may be deformed after getting hot, which affects the product quality, a fan 56 is hung on the folding mechanism mounting plate 16. The pressing mechanism 3 and the folding mechanism 2 is cooled by the fan 56. The fan 56 is provided with a switch.

In order to facilitate counting, a counting device is provided on the pressing mechanism mounting plate 28. Said counting device comprises a counter 57, a display screen 58 for displaying a number and a magnet 59 cooperating with the counter 57, wherein said magnet 59 is provided on the bottom plate 64, and the bottom plate 64 is located below the pressing mechanism mounting plate 28. When the fourth driving mechanism drives the pressing mechanism mounting plate 28 to move downward, the counter 57 senses the magnet 59 and counts the number of processes.

Said bottom plate 64 is provided with a buffer protrusion 60. The buffer protrusion 60 can prevent collision between the pressing mechanism mounting plate 28 and the bottom plate 64, thereby prolonging the service life of the products.

The circuit between said controller 9 and the power source is provided with an emergency switch 61. When an emergency occurs, the main power source is cut off by the emergency switch 61 and the production is ensured in an ordered and safe manner.

The process using the present invention is as follows:

A wound tubular material 4 is mounted on a material shaft 6 of a feeding mechanism, the tubular material 4 successively passes through a roller pair and a support roller 49, the lower end is mounted between an outer sheath 14 of a folding mechanism 2 and a first inner rotor 13 and extends out of the folding mechanism 2.

A mounting seat 24 of a pressing mechanism 3 moves above a fixing sleeve 23 such that a clamping pin 34 on the mounting seat 24 is connected to an elastic seat 22, the mounting seat 24 can axially move under the action of an external force, and a mounting disc 62 is mounted on the mounting seat 24.

A first switch 39 is opened, a gas cylinder drives a pressing mechanism mounting plate 28 and a pressing mechanism 3 on the pressing mechanism mounting plate 28 to move upward, such that a second inner rotor 21 of the pressing mechanism 3 is connected to the first inner rotor 13 of the folding mechanism 2, and when a position sensor 42 is in contact connection with the pressing mechanism mounting plate 28 and is touched to turn on, a signal is sent to a controller 9, and the controller 9 controls the synchronous rotation of a first electric motor 10 and a second electric motor. At the same time, after the pressing mechanism 3 is connected to the folding mechanism 2, the tubular material 4 is pulled such that a sensor 51 located on one side of the support roller 49 senses a signal and sends same to the controller 9, and the controller 9 controls the operation of a third electric motor 43 to deliver, fold and press the tubular material 4. The folded tubular material 4 is stacked on the mounting disc 62, and the mounting seat 24 and the mounting disc 62 are driven to axially move downward.

When the number counted by a meter counter 48 reaches a preset length, a signal is sent to the controller 9, and the controller 9 controls the machine to stop.

A pedal switch is used to control the retraction of a gas cylinder rod 63 of the gas cylinder such that the pressing mechanism mounting plate 28 and the pressing mechanism 3 move downward, and the controller 9 controls the operation of the gas cylinder so as to drive a heating cutting wire 53 to cut the tubular material 4 or reset after the cutting is completed.

A hand lever 31 is rotated such that the mounting seat 24 of the pressing mechanism 3 axially moves downward to reset, an upper cover is laid above the folded tubular material 4, and the folded tubular material 4 is taken from the pressing mechanism 3, so as to complete all the operations.

The above-mentioned embodiment is only one of the preferred embodiments of the present invention, and is not intended to limit the scope of the implementation of the present invention. Equivalent changes made according to the shape, structure and principle of the present invention shall be contained within the scope of protection of the present invention.

What is claimed is:

1. A rotary-type film folding machine, characterized by comprising:

a feeding mechanism providing a tubular material for a folding mechanism in an axial direction, comprising a frame body, a material shaft and one or more feeding rollers being provided on the frame body, a tubular body being provided on a lower part of the frame body, and a first driving mechanism driving the tubular body to rotate so as to drive the rotation of the frame body;

a folding mechanism folding the tubular material delivered by the feeding mechanism, comprising a first inner rotor and an outer sheath, spiral pieces being respectively being provided on an outer wall of the first inner rotor and on an inner wall of the outer sheath, a folding cavity for the tubular material being formed between the first inner rotor and the outer sheath, and said outer sheath being driven by a second driving mechanism to rotate;

a pressing mechanism pressing the tubular material folded by the folding mechanism, comprising a second inner rotor, an elastic seat and a fixing sleeve being successively sheathed outside the second inner rotor, a mounting seat being provided outside the fixing sleeve, being capable of axially moving along the fixing sleeve and being elastically connected to the elastic seat at an upper end of the fixing sleeve, the second inner rotor being driven by a third driving mechanism to rotate, and the second inner rotor being connected to the first inner rotor of the folding mechanism so as to drive the first inner rotor to rotate together;

said pressing mechanism being driven by a fourth driving mechanism to move up and down so as to achieve the connection and disconnection of the first inner rotor of the folding mechanism and the second inner rotor of the pressing mechanism; and the operations of said first, second, third and fourth driving mechanisms being controlled by a controller.

2. The rotary-type film folding machine according to claim 1, characterized in that said first driving mechanism comprises a first electric motor, a first input gear is provided on an output shaft of the first electric motor, a first output gear in meshed transmission with the first input gear is provided outside a tubular body of the feeding mechanism, and the first electric motor rotates to drive the rotation of the feeding mechanism via the meshed transmission of the first input gear and the first output gear.

3. The rotary-type film folding machine according to claim 2, characterized in that a circuit between said controller and the first driving mechanism is provided with a fine-tuning knob for fine-tuning the rotation speed of the first electric motor and a first switch for powering on and off the first driving mechanism.

4. The rotary-type film folding machine according to claim 1, characterized in that said second driving mechanism comprises a second electric motor, a second input gear is provided on an output shaft of the second electric motor, a second output gear is provided on the outer surface of the outer sheath of the folding mechanism, and the second input gear and the second output gear are in meshed transmission so as to drive the rotation of the outer sheath.

5. The rotary-type film folding machine according to claim 1, characterized in that said third driving mechanism and the second driving mechanism both use a second electric motor as power, a third input gear is further provided in the corresponding position on the output shaft of the second electric motor, the second inner rotor of the pressing mechanism is connected to a third output gear in meshed transmission with the third input gear, and the third output gear drives the second inner rotor to rotate and also drives the first inner rotor to rotate together after the first inner rotor is connected to the second inner rotor.

6. The rotary-type film folding machine according to claims 1, characterized by further comprising a position sensor for sensing the connection between the folding mechanism and the pressing mechanism, and when the position sensor senses the connection between the folding mechanism and the pressing mechanism, a signal is sent to the controller, and the controller controls the first electric motor and the second electric motor to work at the same time and in turn drive the first driving mechanism, the second driving mechanism and the third driving mechanism to operate at the same time.

7. The rotary-type film folding machine according to claim 1, characterized in that said feeding roller comprises a roller pair which consists of a driving roller and a driven roller, the driving roller is driven by a fifth driving mechanism to rotate, and the operation of the fifth driving mechanism is controlled by the controller.

8. The rotary-type film folding machine according to claim 7, characterized in that said fifth driving mechanism is a belt transmission mechanism, comprising a third electric motor, a belt wheel is provided on an output shaft of the electric motor, an annular groove is provided on the driving roller, and a belt connects the belt wheel and the groove of the driving roller.

9. The rotary-type film folding machine according to claim 7, characterized in that several rubber rings for increasing frictions are arranged at intervals on the outer surface of said driven roller.

10. The rotary-type film folding machine according to claim 7, characterized in that on one side of said driving roller, a meter counter is provided for counting the feeding length of the tubular material according to the number of rotations of the driving roller, said meter counter is electrically connected to the controller, and the controller controls downtime of the machine.

11. The rotary-type film folding machine according to claim 7, characterized in that said feeding roller further comprises support rollers arranged on the frame body below the roller pair, said support rollers are arranged at two ends of a connecting frame, and the middle part of the connecting frame is swingably connected to the frame body via a connecting shaft.

12. The rotary-type film folding machine according to claim 7, characterized in that said feeding mechanism is provided with a sensor, the sensor pulls the tubular material after sensing the connection between the pressing mechanism and the folding mechanism and sends a signal to the controller, and the controller controls the operation of the third electric motor to in turn control the operation of the fifth driving mechanism.

13. The rotary-type film folding machine according to claim 1, characterized by further comprising a cutting mechanism.

14. The rotary-type film folding machine according to claim 13, characterized in that said cutting mechanism comprises a cutting support, an upper part of the cutting support is connected to a gas cylinder, a lower part of the cutting support is provided with a heating cutting wire, the gas cylinder drives the cutting support to swing, the heating cutting wire cuts the tubular material or resets after the cutting is completed, and the operations of said gas cylinder and the heating of the heating cutting wire are both controlled by the controller.

15. The rotary-type film folding machine according to claim 1, characterized by further comprising a fan for cooling the pressing mechanism and the folding mechanism.

16. The rotary-type film folding machine according to claim 1, characterized in that the support of said pressing mechanism is provided with a counting device.

17. The rotary-type film folding machine according to claim 16, characterized in that said counting device comprises a counter, a display screen for displaying a number, and a magnet cooperating with the counter, and when the pressing mechanism is lifted or lowered, the magnet and the counter sense and count the number of processes.

18. The rotary-type film folding machine according to claim 1, characterized in that several axially arranged strip-shaped guiding grooves are circumferentially distributed on the fixing sleeve of said pressing mechanism, and lower ends of the strip-shaped guiding grooves do not penetrate the wall of the fixing sleeve while upper ends of the strip-shaped guiding grooves penetrate the wall of the fixing sleeve;

said elastic seat comprises several stand poles, a spring is sheathed outside the stand pole, the stand pole at the upper end of the spring is further provided with a movable block which moves up and down along the stand pole, the movable block is limited on the inner top face of the fixing sleeve, and clamping grooves are arranged on the movable block in one-to-one correspondence with the strip-shaped guiding grooves;

said mounting seat comprises an upper seat, a bottom seat, and a hand lever located between the upper seat and the bottom seat, the hand lever is provided with circumferentially distributed arc-shaped inclined guide grooves and arc-shaped guide grooves, clamping pins are radially arranged on the upper seat, the positions of the clamping pins are in one-to-one correspondence with the strip-shaped guiding grooves on the fixing sleeve, the clamping pin is provided with a guiding rod in an axial direction, the guiding rod is connected to the arc-shaped inclined guide groove on the hand lever, a guiding post is provided in the arc-shaped groove, and the upper seat is connected to the bottom seat via a screw passing through the guiding post;

when the mounting seat axially moves above the fixing sleeve, the hand lever is rotated such that the clamping pin moves along the arc-shaped inclined guide groove to extend out of the upper seat and passes through the upper end of the strip-shaped guiding groove and extend into the clamping groove of the movable block of the elastic seat so as to connect to the elastic seat; or is retracted into the upper seat, such that the mounting seat moves downward along the fixing sleeve to reset.

19. The rotary-type film folding machine according to claim 1, characterized in that a circuit of said controller and the fourth driving mechanism is provided with a second switch and a third switch for controlling the operation of the fourth driving mechanism.

20. The rotary-type film folding machine according to claim 1, characterized in that a circuit between said controller and the power source is provided with an emergency switch.

* * * * *